United States Patent [19]

Colling

[11] Patent Number: 5,074,488

[45] Date of Patent: Dec. 24, 1991

[54] AIRCRAFT ENGINE DEACTIVATION APPARATUS

[76] Inventor: Robert E. Colling, 920 Dolbeer, Pocatello, Id. 83201

[21] Appl. No.: 527,317

[22] Filed: May 23, 1990

[51] Int. Cl.[5] ..... G08B 21/00

[52] U.S. Cl. ..... 244/1 R; 244/76 R; 244/121; 340/904; 340/945

[58] Field of Search ..... 340/904, 942, 943, 945, 340/958, 426; 244/76 R, 1 R, 53 R, 121; 180/279; 440/1

[56] References Cited

U.S. PATENT DOCUMENTS

| | | | |
|---|---|---|---|
| 3,203,305 | 8/1965 | Fairbanks | 340/945 |
| 3,448,822 | 6/1969 | La Lone et al. | 340/904 |
| 3,789,950 | 2/1974 | Strenglein | 340/904 |
| 3,921,749 | 11/1975 | Kawada | 340/904 |
| 3,935,559 | 1/1976 | Straffon | 180/279 |
| 4,407,388 | 10/1983 | Steel | 340/904 |
| 4,688,656 | 8/1987 | Kent | 180/279 |

*Primary Examiner*—Joseph F. Peters, Jr.
*Assistant Examiner*—Virna Lissi Mojica
*Attorney, Agent, or Firm*—Paul F. Horton

[57] ABSTRACT

Aircraft engine deactivation apparatus for stopping an aircraft engine while the aircraft is on the ground. The apparatus is for safety purposes and is used to prevent a detected object from coming into contact with an engine driven propeller or a jet propulsion intake. A detector, preferably an infra-red radiation sensor, detects an object or person within a selected distance and within a seleced area about the engine. Upon detection, a mechanical engine deactivator, such as brake calipers engageable with the engine flywheel, or an electronic deactivator, such as an electronic switch operable to ground magnetos, shuts down the engine. A by-pass switch renders the system inoperable, when desired.

9 Claims, 1 Drawing Sheet

AIRCRAFT ENGINE DEACTIVATION APPARATUS

BACKGROUND OF THE INVENTION

1. Field of the Invention

This invention relates, in general, to aircraft safety devices and, more particularly, to apparatus which deactivates an aircraft engine to prevent accidental contact between a person or object and the propulsion system.

2. Description of the Prior Art

Accidents in which people are struck by the rotating propeller of an aircraft or where objects are sucked into the intake of a jet propulsion engine are well known. Often, in boarding an aircraft, particularly small aircraft, passengers often come within dangerously close proximity to the rotating propellers. Not only are passengers at risk, but servicemen, by the manual rotation of the propeller during the servicing procedure, are also at risk in inadvertently starting the engine.

No devices are known which can prevent such accidents. Warning devices, as shown in U.S. Pat. No. 4,528,564, issued to U. Trampnau, give a signal to the operator, when a portion of the aircraft comes to close to the ground or an obstruction during flight, but such a device is useable only during flight and no automatic deactivation takes place.

SUMMARY OF THE INVENTION

The present invention comprises, generally, a detector for sensing the presence of a human being or an object in close proximity to the engine of an aircraft and an engine deactivator to shut down the engine to prevent contact between the person or object and the engine or propulsion system driven by the engine. An override switch is provided to deactivate the system to prevent interference with the normal activity of the aircraft, when desired.

BRIEF DESCRIPTION OF THE THE DRAWINGS

DETAILED DESCRIPTION OF THE INVENTION

Figure 1:
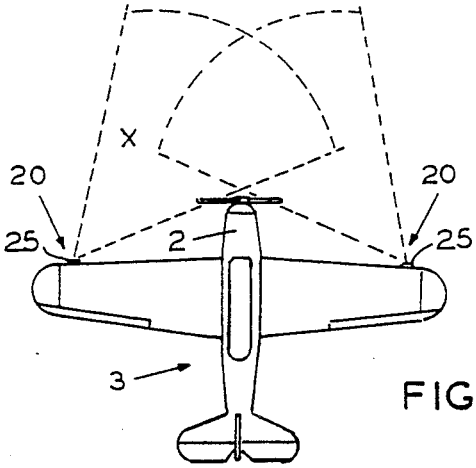
FIG. 1 is a sketch showing use of aircraft engine deactivation apparatus of the present invention on a propeller driven plane utilizing an infra-red radiation detector.
Figure 2:
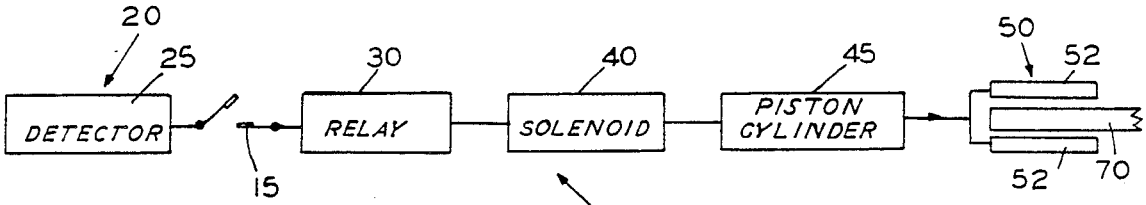
FIG. 2 shows, in block diagram, operation of the apparatus utilizing brake calipers for preventing rotation of the flywheel of an aircraft engine.

Referring now to the drawings and to FIGS. 1 and 2, in particular, an embodiment to be preferred of engine deactivation apparatus 10, made according to the present invention is disclosed. Apparatus 10 includes, generally, detector means designated by the numeral 20 and engine deactivation means, designated by the numeral 50.

Detector means 20, in the preferred embodiment, includes at least one infra-red electromagnetic radiation detector 25 mounted on aircraft 3 and directed to cover an area adjacent engine 2 of the aircraft. While the detectors may be mounted at any advantageous location on the aircraft, it is contemplated that wing mounting will allow superior coverage. Infra-red detectors are well known and are in wide spread usage for many purposes. Either of the two general classes of infra-red detectors, namely, thermal detectors or photo detectors may be used. Such detectors either create a voltage, as in the Golay cell, or cause a change in electrical characteristics, as for example a change in resistance, of a material, as in the bolometer, to cause a change in voltage. The infra-red radiation detector responds to radiation in the infra-red range, commonly called the heat range, and is preferred as a detector in that a transmitter is unnecessary and the detector does not respond to any object, such as a rotating propeller, but rather responds only to radiation as is given off by humans, animals, and other heat radiating objects, designated by the letter X in the drawings. Sensitivity, range, and direction are readily controllable to prevent unwanted detection.

Figure 4:
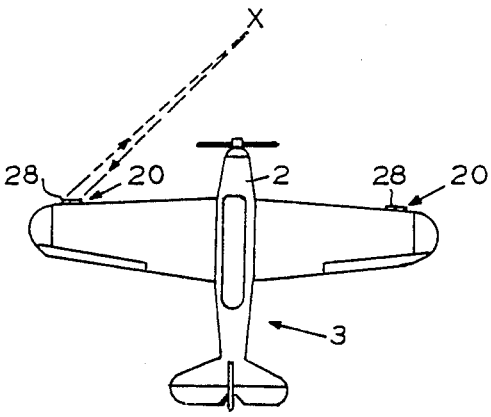
FIG. 4 is a sketch showing use of the engine deactivation apparatus of the present invention on a propeller driven plane utilizing a radio wave or acoustic wave transmitter and detector.
Figure 5:
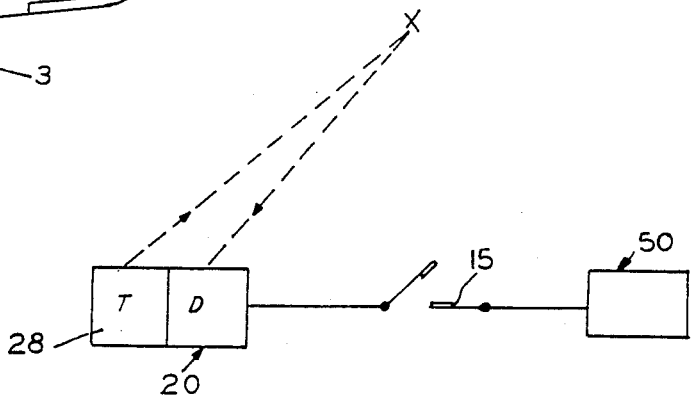
FIG. 5 shows, in block diagram, operation of the apparatus when using a radio or acoustic wave transmitter.

While infra-red radiation detectors are preferred, radar and sonar units, shown in FIGS. 4 and 5, may likewise be used. Such units include a radio or acoustic wave transmitter 28, as the case may be, to transmit radio or sound waves which are reflected off the object X and a radio or wave detector, respectively, for receiving and sensing the reflected waves. Scanners, not shown, are preferred where radar or sonar is utilized. Like the infra-red detector, a voltage is created or changed in response to the received signal, to provide a voltage output from the detector.

Upon excitation of the detector and once a voltage threshold is obtained, the detector operates to activate engine deactivation means 50. In one embodiment to be preferred, shown in FIG. 2, output from the detector is operable to actuate a relay 30 which, in turn, actuates a solenoid 40 to operate a hydraulic piston-cylinder unit 45, such as a slave cylinder, causing closure of brake calipers 52, conventional in automobile braking systems, about a fly-wheel 70 of aircraft engine 2 to immediately shut down the engine to prevent further rotation of the propeller. While a relay is shown to provide adequate power to operate the solenoid, it is obvious that power amplifiers and the like may also be used for this purpose.

Figure 3:
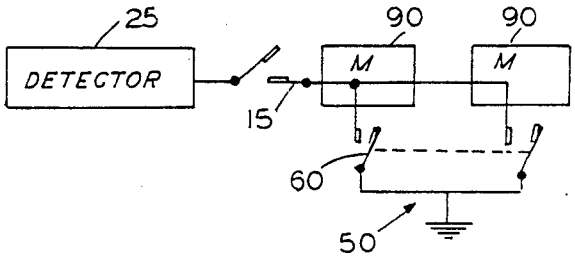
FIG. 3 shows, in block diagram, operation of the apparatus utilizing an electronic switch to ground the magnetos of an aircraft engine to stop the engine.

In a second embodiment, shown in FIG. 3, output from the detector is fed directly, or through an amplifier, not shown, to an electronic switch 60 which, when activated, is operable to ground magnetos 90 to prevent further spark and to thus shut down the engine to stop rotation of the propeller.

In all systems, an override switch 15 is provided to prevent unwanted shut down of the engines, as during the take off and landing procedure and during flight. While a single internal combustion engine driving a single propeller is shown in the figures, it is contemplated that the apparatus 10 of the present invention may be used with aircraft employing multiple engines or with jet propulsion engines to shut down the engines to protect people from being injured and to prevent aircraft damage.

In operation, and utilizing the conditions shown in FIG. 1, for example, aircraft 3 is provided with a pair of infra-red radiation detectors 25 mounted on the forward part of each wing. The detector may be positioned to cover the selected are and distance shown by the dotted lines in the figure. Such an area may include the rotating propeller and even cover an area extending rearward of the propeller as shown. The number and location of detectors may vary. Assuming override switch 15 is in the closed position to electrically connect the detector to the relay, and assuming a person X enters the field covered by the detector, radiation given off by the person is received by the detector which then, by means of relay 30, causes actuation of solenoid 40 to control piston-cylinder unit 45 which causes brake calipers 52 to engage rotating flywheel 70 of aircraft engine 2 to prevent further rotation of the flywheel and thus shut down the engine to prevent further rotation of the propeller.

Having thus described in detail preferred embodiments of the present invention, it is to be appreciated and will be apparent to those skilled in the art that many physical changes could be made in the apparatus without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein. The term "object", used in the appended claims, is meant to include human beings as well as other forms of life.

I claim:

1. Safety apparatus for stopping an engine on a propeller driven aircraft comprising:

detector means mounted on the aircraft for detecting an object within a selected distance from the engine; and engine deactivation means controlled by said detector means for stopping an engine upon detection of an object within said selected distance.

2. The apparatus as described in claim 1 further comprising a detector override switch for preventing engine deactivation by said detector means.

3. The apparatus as described in claim 1 wherein said detector means comprises at least one infra-red radiation detector for receiving infra-red radiation from an object.

4. The apparatus as described in claim 1 further comprising a radio wave transmitter and wherein said detector means comprises a radio wave receiver for receiving radio waves emitted from the transmitter and reflected by an object.

5. The apparatus as described in claim 1 further comprising an acoustic wave transmitter and wherein said detector means comprises an acoustic wave receiver for receiving acoustic waves reflected by the object.

6. The apparatus as described in claim 1 wherein the engine includes a flywheel and wherein said engine deactivation means comprises hydraulic brake calipers engageable with the flywheel upon actuation by said detector means to stop the engine.

7. The apparatus as described in claim 1 wherein said aircraft is provided with at least one magneto and wherein said engine deactivation means includes an electronic switch operable to ground said magneto upon activation by said detector means

8. Safety apparatus for stopping an engine on a propeller driven aircraft, said apparatus comprising:

at least one infra-red radiation detector mounted on the aircraft and directed to an area adjacent the propeller;

a solenoid actuated by said detector; and brake means controlled by said solenoid to deactivate the engine upon the sensing of an object by said detector.

9. The apparatus as described in claim 8 further comprising an override switch operable to prevent actuation of said brake means by said detector.

* * * * *